US006039265A

United States Patent [19]

Dupre et al.

[11] Patent Number: 6,039,265

[45] Date of Patent: Mar. 21, 2000

[54] PORTABLE SNOW MAKING SYSTEM FOR HOME USE

[76] Inventors: Herman K. Dupre, c/o Seven Springs, Champion, Pa. 15622; Charles N. Santry, 409 Heath St., Chestnut Hill, Mass. 02167

[21] Appl. No.: 09/283,844

[22] Filed: Apr. 1, 1999

[51] Int. Cl.[7] ..... F25C 3/04

[52] U.S. Cl. ..... 239/14.2; 239/273; 239/280; 239/281; 239/423; 239/722

[58] Field of Search ..... 239/2.2, 14.2, 239/273, 280, 280.5, 281, 418, 423, 433, 722

[56] References Cited

U.S. PATENT DOCUMENTS

| | | | |
|---|---|---|---|
| 2,676,471 | 4/1954 | Pierce, Jr. | 239/722 X |
| 3,298,612 | 1/1967 | Torrens | 239/402 |
| 3,831,844 | 8/1974 | Tropeano et al. | 239/14 |
| 3,908,903 | 9/1975 | Burns, Jr. | 239/2 |
| 4,004,732 | 1/1977 | Hanson | 239/14.2 X |
| 4,993,635 | 2/1991 | Dupre | 239/14.2 |
| 5,289,973 | 3/1994 | French | 239/14.2 |
| 5,699,961 | 12/1997 | Ratnik et al. | 239/14.2 |
| 5,836,513 | 11/1998 | Smith et al. | 239/14.2 X |

FOREIGN PATENT DOCUMENTS

| | | | |
|---|---|---|---|
| 2208471 | 8/1990 | Japan | 239/14.2 |

*Primary Examiner*—Andres Kashnikow
*Assistant Examiner*—Robin O. Evans
*Attorney, Agent, or Firm*—Carothers & Carothers

[57] ABSTRACT

A portable snow making system for home use which is mounted on a wagon for easy portability. An elongated telescoping support pole is detachably supported from the base of the wagon and a snow making gun is mounted on the upper end of this support pole. Snow making nozzles are provided in the gun for ejecting air and water under pressure into the ambient subfreezing atmosphere for manufacturing snow. A high pressure water pump and an air compressor are also mounted on the wagon to provide sources of water and air under pressure to the snow gun. The snow gun is provided with a housing with a water inlet and an air supply tube passes through this housing for exposure of its exterior surfaces to the interior of the housing in order to warm the air tube and prevent freeze-up of the air tube and the air nozzle.

12 Claims, 2 Drawing Sheets

PORTABLE SNOW MAKING SYSTEM FOR HOME USE

BACKGROUND OF THE INVENTION

The present invention pertains to a snow making system for manufacturing snow in subfreezing ambient conditions for snow sledding, skiing or boarding. More particularly, the present invention pertains to such a snow making system which is portable and adapted for home use.

Snow making equipment has been available for many years for the ski resort industry. However, equipment available for manufacturing snow in subfreezing conditions for ski resorts is far too expensive for the average home owner to utilize such equipment at home. In addition, while some snow making equipment used in the industry is portable in nature, it is not sufficiently portable for home use.

It is principal object of the present invention to provide a portable snow making system for home use which is inexpensive to manufacture and easy to use.

SUMMARY OF THE INVENTION

The portable snow making system for home use of the present invention includes a portable snow making tower which has an elongated support pole that is supported from a base and is further provided with a snow making gun mounted on the upper end of the pole. Snow making nozzles are provided in the gun for ejecting air and water under pressure into ambient atmosphere for making snow in subfreezing conditions.

Air and water inlets are provided on the gun for respective connection to sources of air and water under pressure from an air compressor and water pump, which are mounted on a hand towable vehicle such as a wagon or sled. Respective high pressure hoses connect the snow gun to the sources of air and water under pressure on the wagon.

A low pressure hose is connected to the water pump for connecting the water pump to a supply of water. For example, such a supply might be a common household water spigot or an adjacent outdoor water pond.

The base of the support pole which supports the snow gun at the top thereof is also supported on the towable vehicle and the entire system moves easily as a hand towable unit. Extra storage may also be provided on the towable vehicle for storing hoses and electrical lines.

The high pressure water pump and air compressor will have a combined horsepower rating of less than 12 horsepower thereby making the system extremely portable and readily towable on the towable vehicle. This condition also permits the system to be readily used on available electric supply power normally found in a home. For example, the air pump and water pump may be electric pumps which are operated from a 30 amp 110 volt electric outlet. Of course light weight gasoline operated water pump and air compressor combinations may also be utilized.

The pole which supports the snow gun at the upper end thereof is detachably supported on the towable vehicle and is also preferably telescopically collapsible and extendable so that the height of the snow gun above ground level may be readily varied for storage purposes or for selective positioning of the gun to provide proper placement of manufactured snow.

If the water supply for the high pressure water pump is provided from a common household spigot, it will be found that the water is too warm for manufacturing snow. In this event, it is also preferable to provide a heat exchanger which circulates the water therethrough in the ambient atmospheric cold subfreezing conditions to cool the water prior to the water being delivered to the water pump. In addition, a cooling pool filled with water may be positioned adjacent the towable vehicle for submerging portions of the hoses which feed the water pump and the air compressor and water hoses which feed the snow gun at the top of the support pole for precooling the fluids passing through the hoses.

The snow gun itself which is mounted to the top of the support pole is provided with a housing that has a water inlet for access of water under pressure to the interior of the housing and a water nozzle for spraying water under pressure from the interior of the housing to ambient atmosphere. A tube having opposite ends and passing through this housing for exposure of exterior surfaces thereof to the interior of the housing to warm air passing through the tube is provided with an air inlet at one end thereof for ingress into the tube of air under pressure and an air nozzle at the other end of the tube for discharge of air under pressure into ambient atmosphere. These nozzles are positioned for externally intermixing water and air discharges therefrom for manufacturing snow in subfreezing ambient atmospheric conditions in accordance with known teachings.

The water inlet to the snow gun housing is positioned for directing the flow of water under pressure within the housing toward the end of the air tube which contains the air discharge nozzle for circulating water adjacent the air nozzle in order to prevent the air nozzle from freezing due to freezing of moisture contained within the pressurized air. To further assist this condition, the air nozzle is also preferably recessed into the gun housing.

The support pole for the snow gun extends upward from its support base at an approximate angle of 60°. The water nozzle is angled upwardly at an approximate angle of 45° relative to the support base, and the air nozzle is angled such that it is at an approximate angle of 45° relative to the water nozzle. This configuration provides maximum efficiency for intermixing of the air and water and atomization of the sprayed water to provide maximum efficiency and maximum throw of the manufactured snow. In addition, this configuration further positions the nozzles such that the resulting thrust created by the ejection of air and water under pressure through the nozzles helps to maintain the support pole in an upright position and directs the major portion of the resultant thrust downwardly through the pole in order to subject the support pole to minimum torsional stresses.

The water inlet for the snow gun housing is positioned at a bottom point on the housing whereby all water will drain from the housing through this water inlet when the system is not in use.

BRIEF DESCRIPTION OF THE DRAWINGS

Other objects and advantages of the present invention appear hereinafter in the following description and claims. The accompanying drawings show, for the purpose of exemplification, without limiting the invention or claims thereto, certain practical embodiments of the present invention wherein:

DETAILED DESCRIPTION OF THE PREFERRED EMBODIMENTS

Figure 1:
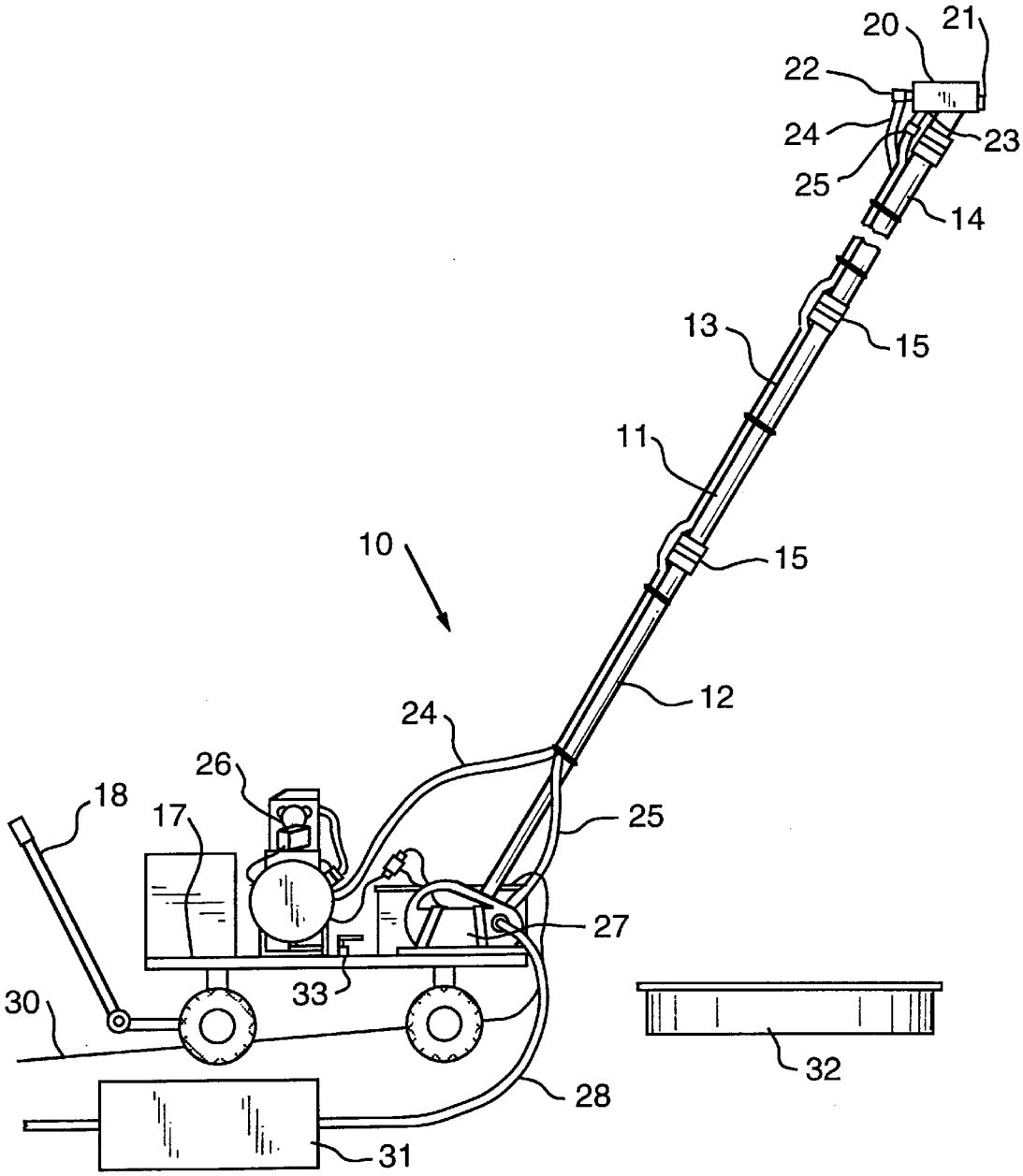
FIG. 1 is a schematic drawing illustrating the portable snow making system for home use of the present invention shown in side elevation.
Figure 2:
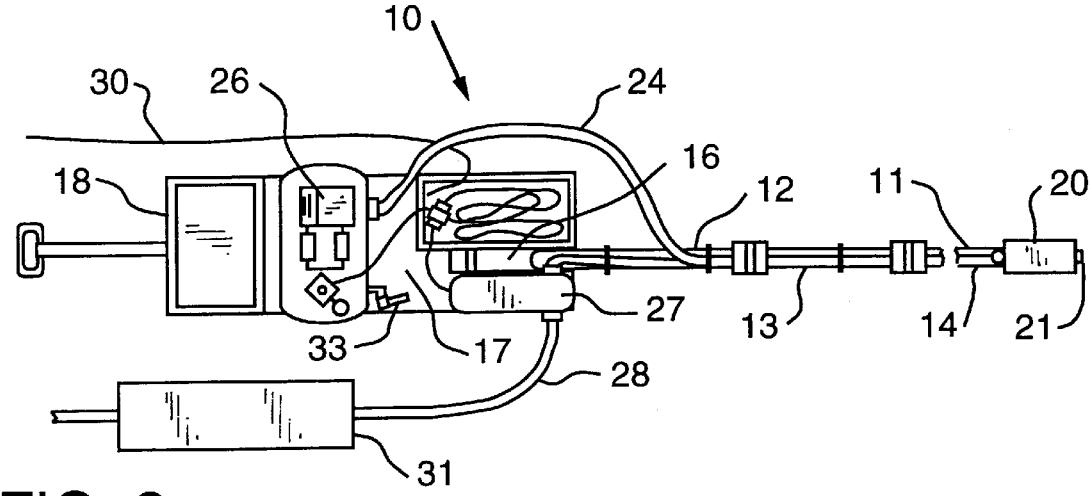
FIG. 2 is a plan or top view of the portable snow making system shown in FIG. 1.

Referring to FIGS. 1 and 2, the portable snow making system 10 includes a portable snow making tower 11 which is an elongated support pole that is telescopically collapsible and extendable in three segments 12, 13 and 14.

The support pole 11 thus may be telescopically fully extended or adjusted to any intermediate position and there retained by tightening stop nuts 15.

Elongated support pole 11 is detachably supported from base 16 which is in turn securely mounted to the base 17 of wagon 18.

A snow making gun 20 is mounted on the upper end of support pole 11.

Figure 3:
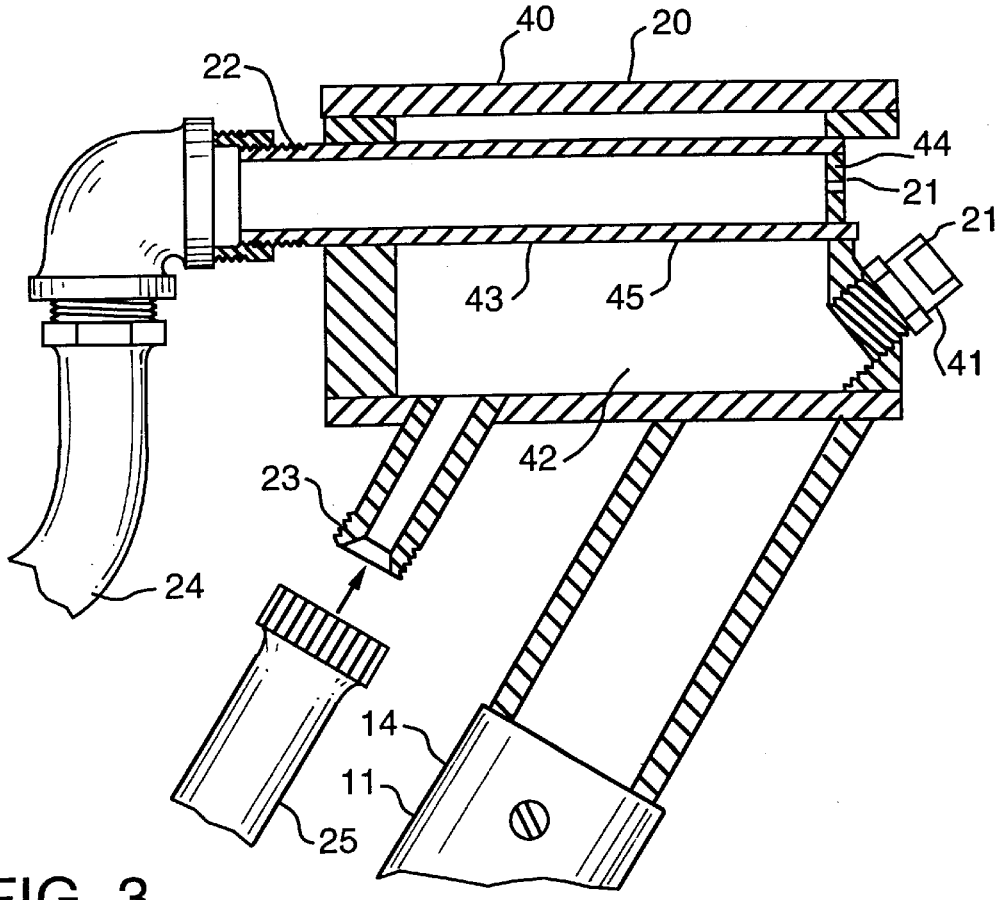
FIG. 3 is an enlarged view in partial vertical mid cross section illustrating the internal workings of the snow making gun mounted on top of the support pole for the portable snow making system for home use shown in FIGS. 1 and 2.

As is best illustrated in FIG. 3, snow making nozzles 21 are provided in gun 20 for ejecting air and water under pressure into ambient atmosphere for making snow in subfreezing conditions. While the system illustrated in these figures is an external mixing system wherein the air and water under pressure are mixed externally of the gun, the principals of the present invention are also applicable to internal mixing guns wherein the air and water under pressure are mixed internally before being ejected into the ambient atmosphere.

Air and water inlets 22 and 23 on gun 20 are provided for respective connection through high pressure hoses 24 and 25 to sources 26 and 27 of air and water under pressure which are an electrically operated water pump and air compressor.

Air compressor 26 and high pressure water pump 27 are securely mounted to the base 17 of hand towable vehicle or wagon 18.

A common garden hose 28 connects high pressure water pump 27 to a common water supply such as an adjacent outdoor pond or to a common water spigot in the home for supplying water to water pump 27.

The combined horse power rating of the water pump 27 and the air compressor 26 is less than 12 horsepower thereby providing a light weight high pressure source for air and water which may be readily operated from a common 30 amp 110 volt electrical outlet normally found in the home. The electricity from the source is supplied to the air compressor 26 and the water pump 27 through the electrical line 30.

As previously explained, support pole 11 is not only telescopically collapsible and extendible, but may be completely detached from the towable vehicle 18 at the base 16. This permits the support pole 11 to be fully extended to normally a full extended position whereby gun 20 is 16 feet off of the ground or to any lesser or intermediate position for assisting in positioning the desired placement of manufactured snow. The support pole 11 also may be fully collapsed so that the entire unit may be readily hand pulled into a garage for storing.

Telescopically collapsible support pole 11 together with its snow making gun 20 mounted at the upper end may be entirely substituted with a conventional support pole 11 which is a non-extendable or collapsible pipe support for conveying air and water therethrough to the upper end thereof to nozzles 21 as has already been described in the prior art for many different type of pipe snow making towers which either internally mix or externally mix air and water under pressure.

If hose 28 is connected up to a common water spigot, the water therefrom is generally too warm for manufacturing snow and therefore a heat exchanger 31 is provided such that the water passing through hose 28 passes first through heat exchanger 31, which is positioned in the ambient freezing atmosphere in order to precool the water before it enters high pressure water pump 27.

Heat exchanger 31 may be in the form of metallic baffled heat exchanger or it may be simply in the form of additional extensions of hose 28 in order to provide supplemental cooling.

In addition, a cooling pool 32 filled with water is also positioned adjacent the towable vehicle 18 for submerging portions of selected ones of the hoses 22, 23 and/or 28 therein for precooling of fluids passing through the hoses for more efficiently manufacturing snow.

The bottom of the air tank for air compressor 26 is also provided with a water drain valve 33 for periodically draining water from condensation which builds up in the tank.

Turning specifically to FIG. 3, snow gun 20 is provided with a housing 40 that has a water inlet 23 as previously explained in a water nozzle 41 for spraying water under pressure from the interior 42 of housing 40 to ambient atmosphere.

Tube 43 having opposite ends 22 and 44, passes through housing 40 for exposure of exterior surfaces 45 thereof to the interior 42 of housing 40 in order to jacket the tube 43 with the warmer water to thereby prevent freeze-up of the moisture within the air tube 43.

An air nozzle 46 is provided at end 44 of tube 43 for discharge of air under pressure into the ambient atmosphere. The air nozzle 46 and the water nozzle 41 are positioned relative to each other for externally intermixing water and air discharges therefrom for manufacturing snow in subfreezing ambient conditions as is known in the prior art. A small wire may be used to clear debris which might plug air nozzle 46.

The water inlet 23 of housing 40 is positioned at a bottom point on housing 40 so that all water will drain from housing 40 through water inlet 23 when the system is off. Additionally, inlet 23 is also positioned whereby the discharge therefrom into the interior 42 of housing 40 is positioned to fully and more efficiently circulate water about the outside 45 of air tube 43 and to further direct the warmer water to the air nozzle 46.

Air nozzle 46 is further recessed into housing 40 as illustrated to provide maximum warming effect from the water blowing within the interior 42 of housing 40 in order to prevent freeze up of air nozzle 46.

The support pole 11 generally extends upward from its support base at an approximate angle of 60° to base 17 and the water nozzle 41 is angled upwardly at approximately an angle of 45° relative to the base 17 of towable vehicle 18.

In addition, air nozzle 46 is angled at an approximate angle of 45° relative to water nozzle 41 thereby providing maximum atomization of the sprayed water from nozzle 41 and maximum efficiency of the snow manufacturing process. In addition, this total arrangement also helps to support the support pole 11 in an upright position and direct the maximum resultant thrusts from the nozzles 44 and 41 downwardly through support pole 11 thereby providing minimum torsional stress against the support pole 11.

I claim:

1. A portable snow making system for home use comprising: a portable snow making tower having an elongated support pole supported from a base and having upper and lower ends with a snow making gun mounted on the upper end, snow making nozzles in said gun for ejecting air and water under pressure into ambient atmosphere for making snow in subfreezing conditions, air and water inlets on said gun for respective connection to sources of air and water under pressure, a hand towable vehicle having mounted thereon a high pressure water pump and an air compressor providing respectively said sources of water and air under pressure, air and water high pressure hoses respectively connecting said sources of air and water under pressure to said air and water inlets on said gun, a hose connected to said water pump for connecting said water pump to a common water supply for supplying water to said water pump, and said pole base supported on said towable vehicle.

2. The portable snow making system of claim 1 wherein said high pressure water pump and air compressor have a combined horse power rating of less than twelve horse power.

3. The portable snow making system of claim 2 wherein said pump and compressor are electrically energizable from commonly available house current.

4. The portable snow making system of claim 1 wherein said pole is detachably supported on said towable vehicle.

5. The portable snow making system of claim 4 wherein said pole is telescopically collapsible and extendable.

6. The portable snow making system of claim 1 wherein said water supply including a water spigot and a heat exchanger for cooling water coming from said spigot.

7. The portable snow making system of claim 1 including a cooling pool filled with water and positioned adjacent said towable vehicle for submerging portions of selected ones of said hoses in said water for precooling of fluids passing through said hoses.

8. The portable snow making system of claim 1, said gun comprising: a housing having said water inlet for access of water under pressure to the interior of said housing and a water nozzle for spraying water under pressure from the interior of said housing to ambient atmosphere, a tube having opposite ends and passing through said housing for exposure of exterior surfaces thereof to the interior of said housing, said tube provided with said air inlet at one end thereof for ingress into said tube of air under pressure and an air nozzle at the other end of said tube for discharge of air under pressure into ambient atmosphere, said nozzles positioned for externally intermixing water and air discharges therefrom for manufacturing snow in subfreezing ambient atmospheric conditions.

9. The portable snow making system of claim 8 wherein said water inlet is positioned for directing the flow of water under pressure within said housing toward said other end of said tube for circulating water adjacent said air nozzle to keep said air nozzle from freezing.

10. The portable snow making system of claim 8 wherein said air nozzle is recessed into said housing.

11. The portable snow making system of claim 8 wherein said support pole extends upward from its support base at an approximate angle of 60°, said water nozzle is angled upwardly at an approximate angle of 45° relative to said support base and said air nozzle is angled at an approximate angle of 45° relative to said water nozzle.

12. The portable snow making tower of claim 8 wherein said water inlet is positioned at a bottom point on said housing whereby all water will drain from said housing through said water inlet when the system is off.

* * * * *